United States Patent [19]

Anhalt

[11] 4,284,313

[45] Aug. 18, 1981

[54] QUICK DETACHABLE ELECTRICAL CONNECTOR

[75] Inventor: John W. Anhalt, Orange, Calif.

[73] Assignee: International Telephone and Telegraph Corporation, New York, N.Y.

[21] Appl. No.: 85,534

[22] Filed: Oct. 17, 1979

[51] Int. Cl.[3] ..... H01R 13/62; H01R 13/635

[52] U.S. Cl. ..... 339/61 M; 285/137 R; 285/260; 285/DIG. 2; 339/91 R; 339/89 M

[58] Field of Search ..... 339/61 R, 61 L, 61 C, 339/61 M, 45 R, 45 M, 59 M, 75 R, 75 M, 75 P, 74 R, 88 R, 89 R, 91 R, 184 R, 184 M, 186 R, 186 M, 188 C; 285/DIG. 22, 137 R, 260, 423

[56] References Cited

U.S. PATENT DOCUMENTS

| | | | |
|---|---|---|---|
| 3,706,067 | 12/1972 | Hanson | 339/91 R X |
| 4,070,080 | 1/1978 | Eshleman et al. | 339/91 R |
| 4,168,105 | 9/1979 | Herrmann | 339/90 R |

*Primary Examiner*—Eugene F. Desmond

*Attorney, Agent, or Firm*—Thomas L. Peterson

[57] ABSTRACT

A quick detachable electrical connector is disclosed in which a resilient hood on the receptacle connector member surrounds the forward portion of the plug connector member. Lugs on the plug connector member snap into recesses in the hood to latch the connector members together. The hood is connected to the body of the receptacle member by longitudinally extending ribs. In one embodiment of the invention, the hood is circular and is rotated to ride up over the latching lugs to release the lugs from the recesses, thereby allowing the connector members to be disengaged. In a second embodiment, the hood is formed in the shape of a parallelogram, the short sides of which are squeezed to cause the hood to release from the latching lugs on the plug connector member.

16 Claims, 14 Drawing Figures

QUICK DETACHABLE ELECTRICAL CONNECTOR

BACKGROUND OF THE INVENTION

This invention relates generally to an electrical connector and, more particularly, to a quick detachable coupling arrangement for an electrical connector.

U.S. Pat. No. 3,133,777 to Anhalt, assigned to the assignee of the present application, discloses a quick detachable electrical connector in which the plug connector member is provided with two externally projecting plugs on its opposite sides and the receptacle connector member has a sleeve rotatably mounted thereon formed with latching recesses which receive the lugs in latching relationship. The sleeve is oval in cross-section with a smaller diameter adapted to be snugly slipped over the plug connector member and the recesses being disposed in the region of such smaller diameter. The larger diameter portion of the oval sleeve provides a clearance between the plug connector member and the larger diameter section. The sleeve is formed of a resilient material. The sleeve is manipulated by squeezing it externally at its larger diameter to increase the smaller diameter section sufficiently so that the lugs may be introduced into or withdrawn from the recesses in the sleeve.

A quick detachable electrical connector operating on a principal similar to that disclosed in the Anhalt patent is shown in FIG. 15 of U.S. Pat. No. 3,146,051 to Woofter, et al. However, the Woofter connector has a rectangular configuration, rather than circular, and embodies only a single latching lug.

The one and two latching lug connectors of Woofter and Anhalt, respectively, are generally satisfactory, but do not provide as great an area of latching engagement as is desired for some applications to assure against inadvertant unmating of the connector halves. For example, if a side load is applied against the plug connector member while the receptacle connector member is fixed, the plug connector member may become skewed relative to the receptacle connector member which may result in the latching lugs releasing from the locking sleeve. The lack of stability of the mating connector members due to the use of only one or two latching lugs also may result in impairment of the interfacial seal between the connector members. Since the connectors require squeezing of the opposite sides of the latching sleeve to release the lugs, additional latching lugs cannot be provided around the plug connector member to assure stability and secure locking of the connector members.

It is the object of the present invention to provide a quick detachable electrical connector which permits the use of more than two latching lugs, thereby providing a more stable and reliable locking with the mated connector members.

SUMMARY OF THE INVENTION

According to the principal aspect of the present invention, there is provided a quick detachable electrical connector providing first and second axially mating connector members. At least one latch element extends outwardly from the first connector member. The second connector member comprises a body having a forwardly extending resilient hood surrounding the first connector member. The hood has a recess therein receiving the latch element when the connector members are fully mated. The region of the hood which embodies the recess is movable relative to the body, and thus the first connector member, in the plane in which it lies. In one embodiment of the invention, the hood has a circular configuration and is rotatable circumferentially about a cylindrical body and, therefore, rotates in a circular plane. In a second embodiment of the invention, the hood has the configuration of a parallelogram, and the region of the hood in which the latching recess is formed is one or both of the longer sides of the parallelogram which are parallel to the top and bottom of a rectangular connector body. In the second embodiment, the top and bottom sides of the parallelogram shaped hood and movable substantially in the flat planes in which they lie by squeezing the angular side portions of the hood. In each embodiment, the latch element and recess in the hood have adjacent longitudinally extending surfaces one of which embodies cam means allowing the hood to ride up over the latch element upon movement of the region of the hood embodying the recess to release the latch element from the recess whereby the connector members may be axially disengaged. Since release of the connector is dependent upon the aforementioned cam action, and not solely upon the squeezing of a latching sleeve or hood as in the prior art connectors described hereinbefore, more than two latching lugs may be used and the lugs may be positioned in a number of locations around the plug connector members to provide a reliable, stable locking arrangement for the connector halves.

DESCRIPTION OF THE PREFERRED EMBODIMENTS

Figure 3:
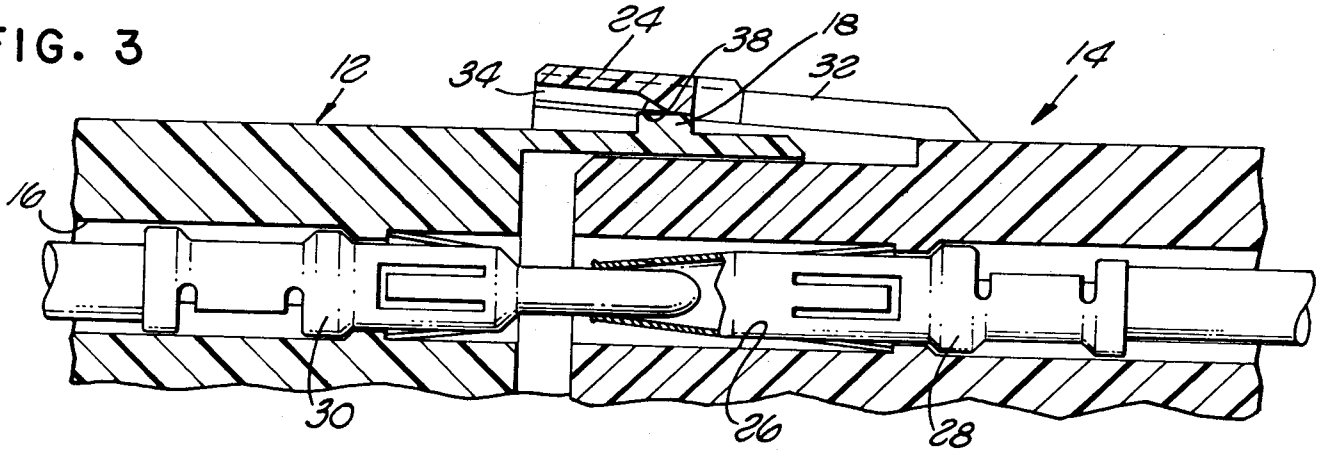
FIG. 3 is a partial longitudinal sectional view similar to FIG. 2 but showing the connector members partially mated.
Figure 4:
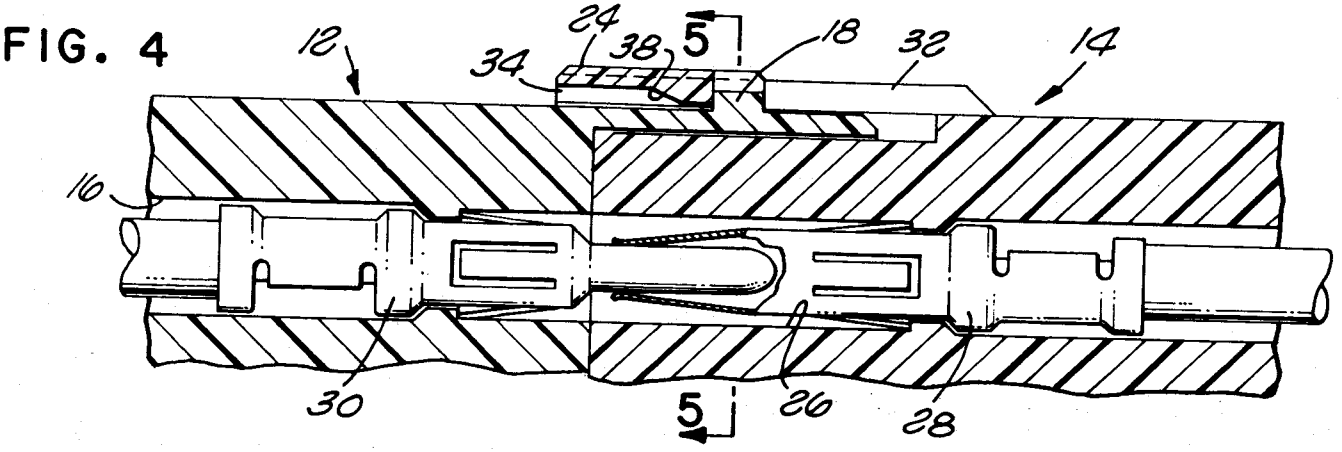
FIG. 4 is a partial longitudinal sectional view similar to FIGS. 2 and 3, but showing the connector members fully mated.
Figure 5:
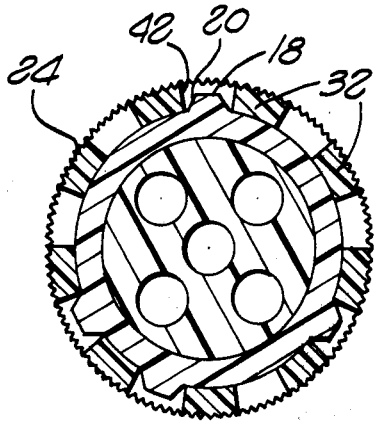
FIG. 5 is a transverse sectional view taken along line 5—5 of FIG. 4 showing the latching lugs on the plug connector member positioned in the recesses in the hood of the receptacle connector member.
Figure 6:
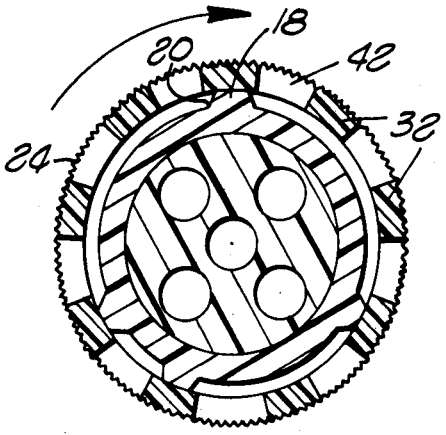
FIG. 6 is a sectional view similar to FIG. 5 showing the hood rotated to a position wherein the latching lugs are removed from the latching recesses.

Referring now to the drawings in detail, there is illustrated in FIGS. 1 to 7 one embodiment of the connector of the invention, generally designated 10, comprising a plug connector member 12 and a receptacle connector member 14. The plug connector member comprises an elongated, generally cylindrical body 15 having a plurality of contact cavities 16 extending axially therethrough, five being shown by way of example only. A plurality of circumferentially spaced latching and polarizing lugs 18 are formed on the forward portion of the body 15. By way of example only, four of such lugs are provided on the body 15, as best seen in FIGS. 5 and 6. Since the lugs are utilized for polarizing purposes, they are spaced about the body 15 in a non-uniform pattern, that is, the circumferential spacing between all the lugs is not identical. The longitudinally extending sides 20 of the lugs are chamfered or beveled for a purpose which will be seen later.

The receptacle connector member 14 comprises a cylindrical body 22 having a resilient cylindrical hood 24 extending forwardly therefrom. As seen in FIG. 4, when the plug and receptacle connector members are mated, the hood surrounds the forward portion of the plug connector member 10. Contact cavities 26 extend axially through the body 22 in a pattern corresponding to the cavities 16 in the plug connector member. Socket contacts 28 are mounted in the cavities 26 which engage mating pin contacts 30 in the contact cavities 16 when the connector members are fully engaged, as seen in FIG. 4.

The hood 24 is connected to the body 22 of the receptacle connector member by a plurality of elongated, thin, flexible ribs 32. The ribs are integrally connected at their forward and rear ends to the hood and body, respectively. Preferably, the entire receptacle connector member, except for the contacts therein, is an integral, one-piece molded plastic part. The ribs 32 must be sufficiently flexible to allow a limited rotational movement of the hood 24 relative to the body 22, and hence, the plug connector member when the plug and receptacle members are mated. Nine of such ribs are shown by way of example only, as best seen in FIGS. 5 and 6.

Figure 1:
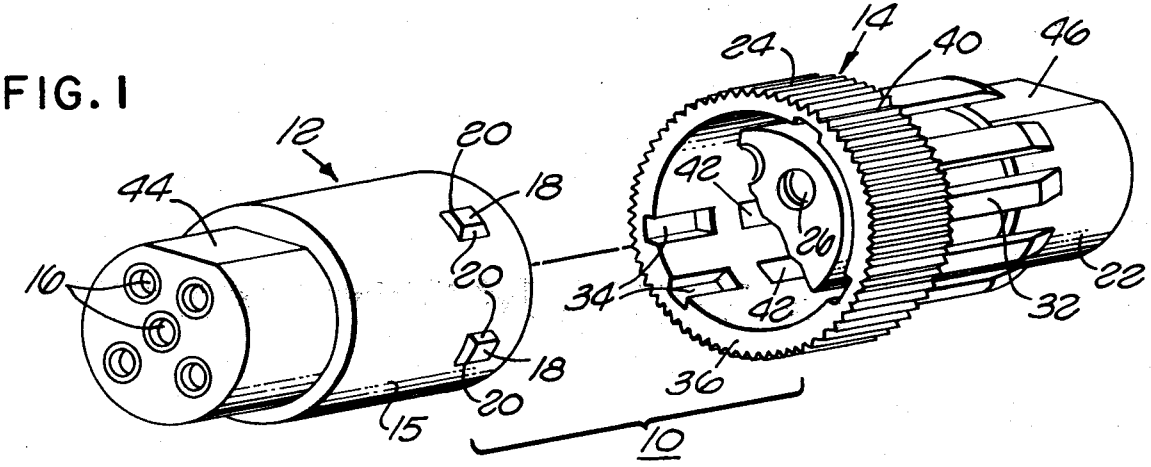
FIG. 1 is an exploded, perspective view of the plug and receptacle connector members on one embodiment of the invention in which the members have a circular configuration.
Figure 2:
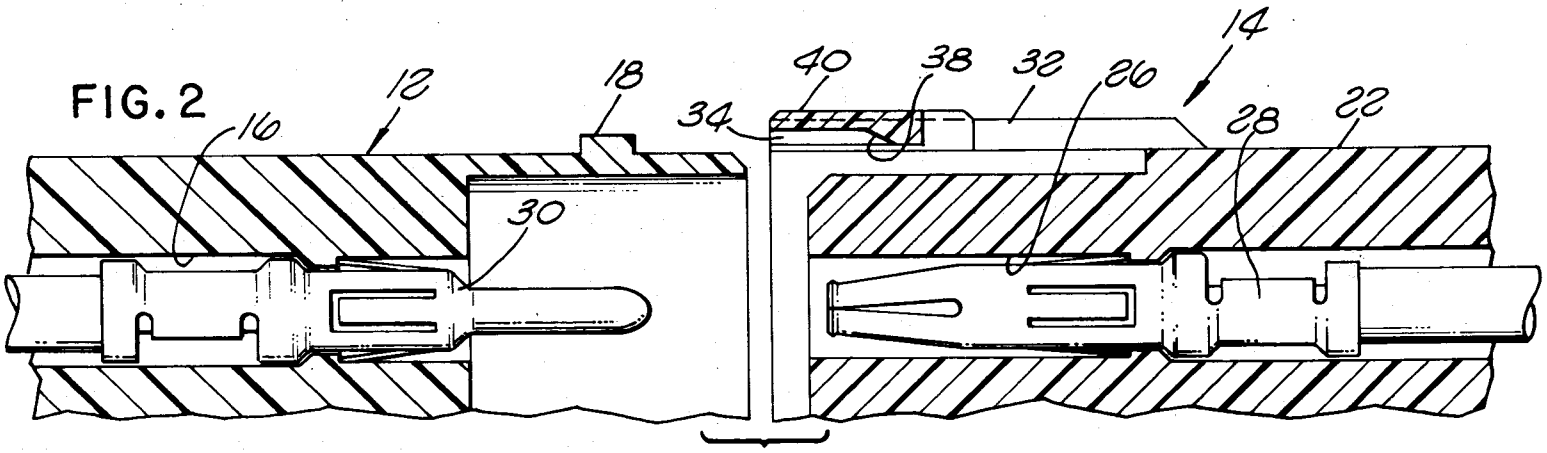
FIG. 2 is a partial longitudinal sectional view of the connector illustrated in FIG. 1 showing the plug and receptacle connector members in an unmated condition.

Blind polarizing keyways 34 are formed in the inner surface of the hood 24. The pattern of the keyways in the hood corresponds to the pattern of the plugs 18 on the plug connector member. The keyways open at the forward end 36 of the hood, and terminate short of the rear of the hood. The blind or inner ends of the keyways are beveled, as indicated at 38 as best seen in FIG. 2. The outer surface 40 of the hood is serrated to facilitate gripping and rotating of the bond. The ribs 32 connecting the hood to the body 22 are arranged so that the keyways 34 are longitudinally aligned with four of the spaces between the ribs, which aligned spaces constitute latching recesses, which are indicated by reference numerals 42.

The connector members 12 and 14 are mated as follows. The plug connector member is positioned relative to the receptacle connector member so that the lugs 18 are generally aligned with the polarizing keyways 34, which may be facilitated by providing flat surfaces on the plug and receptacle connector bodies, which are indicated by reference numerals 44 and 46, respectively. As the connector members are moved axially toward each other, the lugs 18 enter the polarizing keyways 34. As the connector members are pushed further together, the lugs 18 will engage the beveled blind ends 38 of the keyways causing the resilient hood 24 to expand outwardly as seen in FIG. 3. During this stage of engagement, the socket contacts 28 in the receptacle connector member become partially mated with the pin contacts 30 in the plug connector member. Further axial movement of the plug and receptacle members relative to each other causes the lugs to pass the rear of the hood 24 whereupon the hood contracts and the lugs thereby snap into the recesses 42 as seen in FIGS. 4 and 5. Thus, it will be appreciated that the lugs 18 serve as polarizing keys which cooperate with the keyways 34 to assure that the connector members are rotatably positioned relative to each other so that the pin and socket contacts therein will properly mate when the connector members are engaged, and they likewise serve as latching elements which positively lock the connector members together preventing axial disengagement therebetween. In the locked condition of the connector members, the pin and socket contacts are fully mated, as seen in FIG. 4. If desired, the front edges of the lugs 18 may be beveled (not shown) rather than providing the bevels 38 in the keyways 34, or in addition to the bevels 38 to effect the expansion of the hood 24 upon mating of the connector members.

Figure 7:
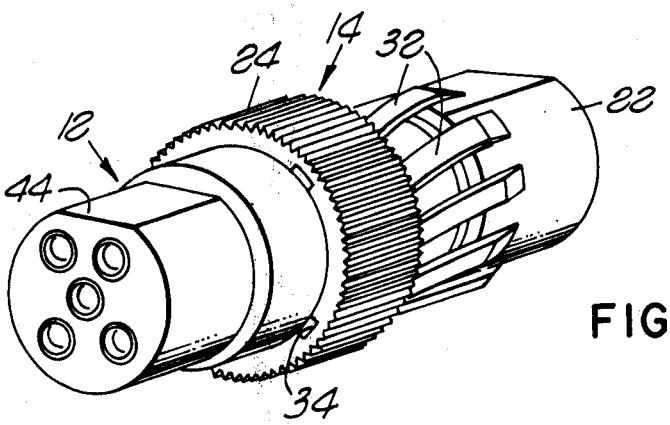
FIG. 7 is a perspective view of the mated connector illustrated in FIGS. 1 to 6 wherein the hood is rotated to its unlatched position corresponding to that illustrated in FIG. 6.

To unmate the connector members, the hood 24 must be rotated a limited distance from the normal latched position illustrated in FIG. 5 to a release position as illustrated in FIG. 6. As seen in FIG. 6, the hood 24 has been rotated in the clockwise direction which causes the ribs 32 on one side of the lugs 18 to engage the beveled sides 20 thereof causing the ribs to ride up over the plugs so that the lugs are released from the latching recesses 42 defined between the ribs. Rotation of the hood causes torsional flexure of the ribs 32, as seen in FIG. 7. With the hood in the position illustrated in FIGS. 6 and 7 wherein the lugs 18 are released from the recesses 42, the plug connector member may be freely withdrawn from the receptacle connector member. Thus, broadly speaking the hood and rib 32 assembly undergoes torsional displacement causing the lugs 18 to disengage from the recesses 42. After the connector members are disengaged, the hood 24 is released whereby it will rotate in a counterclockwise direction as viewed in FIG. 6 by untwisting of the flexed ribs 32 caused by the memory characteristics of the plastic.

It will be appreciated that the hood 24 may be rotated in the counterclockwise direction as viewed in FIG. 6 to release the lugs 18 from the latching recesses rather than in the clockwise direction, and release of the connector members will be effected in the same manner. Thus, the embodiment of the invention illustrated in FIGS. 1 to 7 has the advantage that release of the connector is not subject to a particular point of application of pressure or direction of rotation of the latching hood 24. It will be appreciated that unlatching of the hood from the lugs 18 may be facilitated by providing beveled surfaces (not shown) on the ribs 32 if desired.

Figure 8:
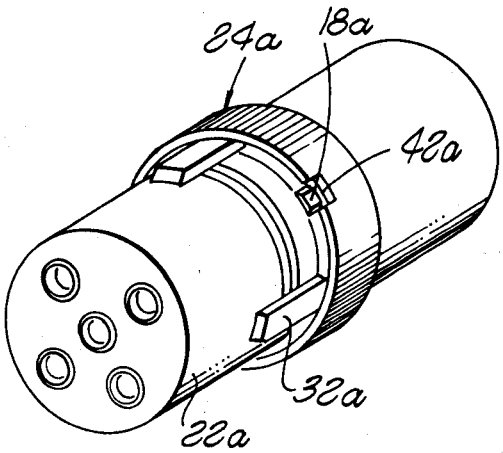
FIG. 8 is a perspective view of a second embodiment of a circular connector in accordance with the present invention.
Figure 9:
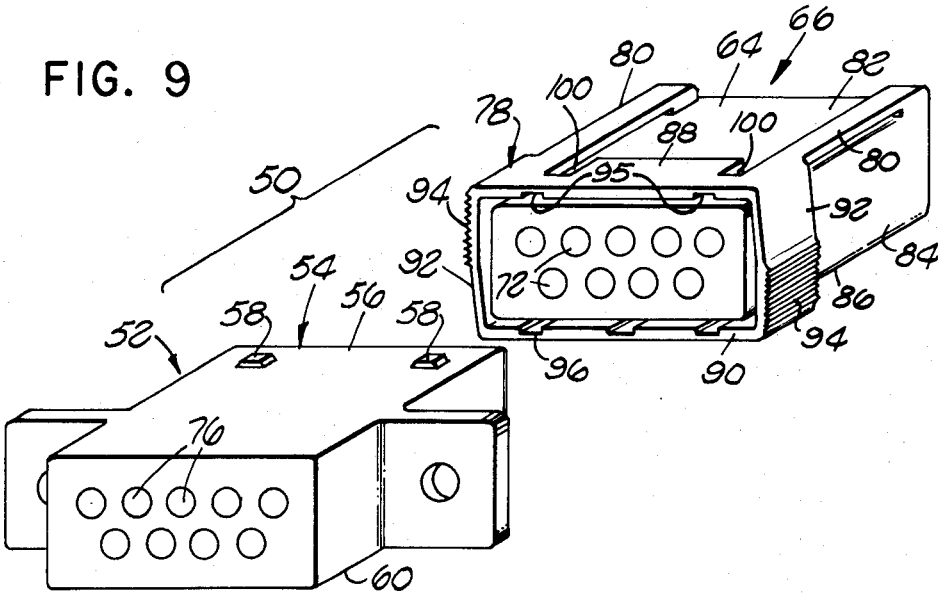
FIG. 9 is an exploded perspective view of a third embodiment of the connector of the present invention having a rectangular configuration.

Reference is now made to FIG. 8 of the drawings which shows a circular connector similar to the connector 10 illustrated in FIGS. 1 to 7. In this embodiment, the hood 24*a* is connected to the receptacle connector body 22*a* by only four elongated ribs 32*a*, and the latching recesses 42*a* for the lugs 18*a* are provided by cutouts opening to the rear of the hood 24*a*, rather than spaces between the ribs 32*a*. While in the embodiment of FIGS. 1 to 7, the latching recesses are provided by the spaces between the ribs 32, the forward portions of the ribs may be considered a part of the hood 24 and thus the latching recesses may be considered as being formed in the hood. Accordingly, when the claims appended hereto describe the hood as having recesses therein for receiving the latching elements, such terminology is intended to embrace both the structures illustrated in FIGS. 1 to 7 and in FIG. 8, as well as that illustrated in FIGS. 9 to 14 which will now be described.

Figure 10:
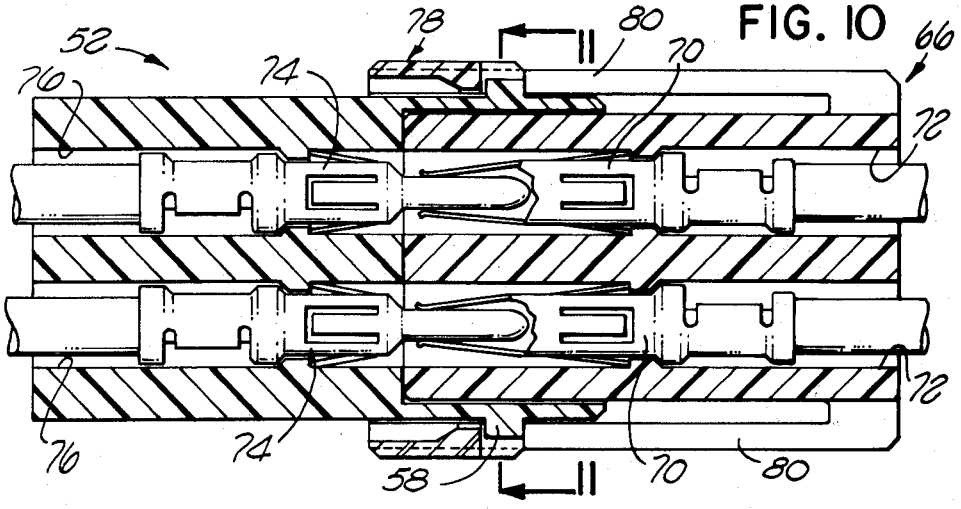
FIG. 10 is a partial longitudinal sectional view of the connector illustrated in FIG. 9 showing the plug and receptacle members in their fully mated position.
Figure 11:
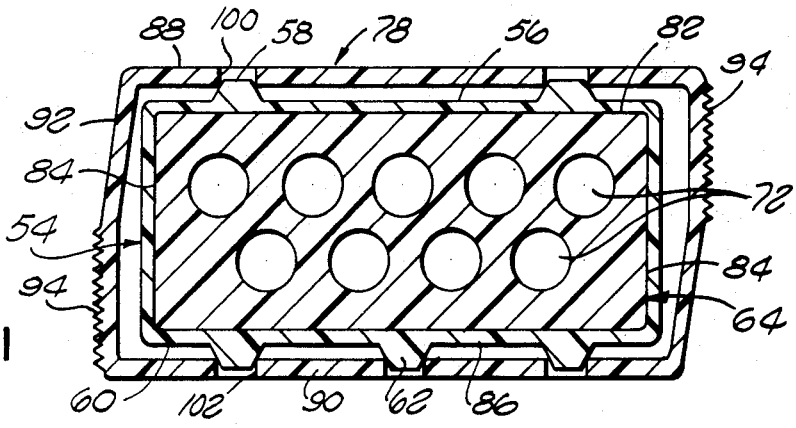
FIG. 11 is a transverse sectional view taken along line 11—11 of FIG. 10 showing the latching lugs on the plug connector member extending into the latching recesses in the hood of the receptacle member.
Figure 14:
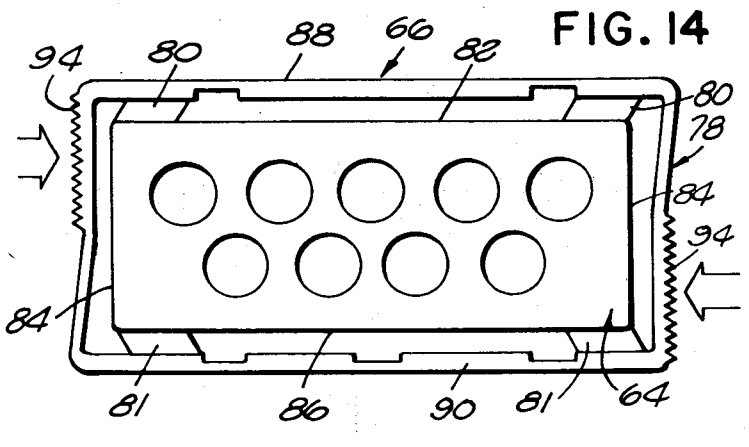
Figure 13:
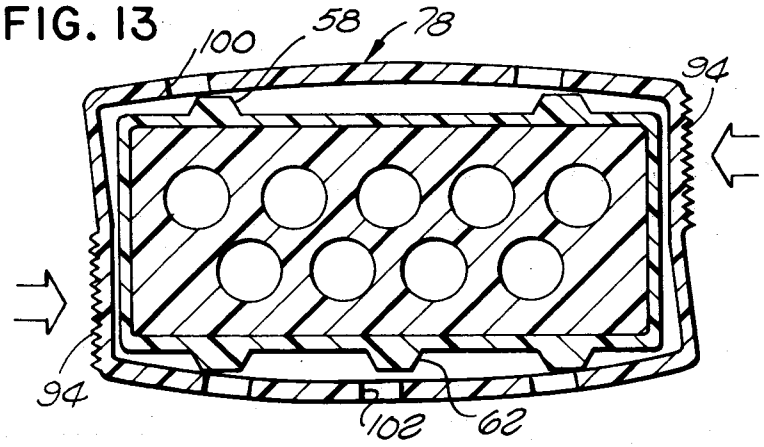
FIG. 13 is a transverse sectional view taken along line 13—13 of FIG. 12; and, FIG. 14 is a front end view of the receptacle connector member of the embodiment of the invention illustrated in FIGS. 9 to 13, with the hood shown in its unlatched position.

The connector 50 illustrated in FIGS. 9 to 14 has a rectangular configuration. More specifically, the plug connector member 52 comprises a body 54 of rectangular cross-section. As best seen in FIG. 11, the top wall 56 of the body 54 is provided with two latching, polarizing lugs 58 while the bottom wall 60 is provided with three lugs 62. The body 64 of the receptacle connector member 66 also has a rectangular cross-section, and is dimensioned to slide into a rectangular recess 68 opening at the forward end of the plug body 54. Socket contacts 70 are mounted in two rows of axially extending contact cavities 72 in the receptacle body 64 which mate with pin contacts 74 in corresponding aligned contact cavities 76 in the plug body 54 when the plug and receptacle connector members are mated. A resilient deformable hood 78 of parallelogram configuration surrounds the forward portion of the receptacle body 64. The hood is adapted to surround the forward portion of the plug body 54 when the connector members are mated. Resilient elongated ribs 80 connect the hood 78 to the rear of the body 64. Two ribs 80 extend above the top wall 82 of the body 64 adjacent to the sidewalls 84 thereof while two other ribs 81 extend along the bottom wall 86 of the body 64 adjacent to the sidewalls as seen in FIG. 14.

The top wall 88 of the hood 78 is flat and parallel to the top wall 82 of the receptacle body 64 and the bottom wall 90 of the hood is flat and parallel to the bottom wall 86 of the body 64. The sidewalls 92 of the parallelogram-shaped hood 78 are parallel and extend at an acute angle relative to the sidewalls 84 of the body 64. Preferably, to reduce the width of the connector, the outer portions 94 of the sidewalls 92 are formed parallel to the sidewalls 84 of the body 64 and are serrated to facilitate gripping of the sides of the hood.

Two blind keyways 95 are formed in the inner surface of the upper walls 88 of hood 78 and three blind keyways 96 are formed in the upper surface of the lower wall 90. The keyways 95 are located to receive the lugs 58 on the upper wall 56 of the plug connector member while the keyways 96 are positioned to receive the lugs 62 on the bottom wall of the plug connector member. The inner ends of the blind keyways are beveled as indicated at 98 in FIG. 10. Two latch recesses 100 are formed in the rear of the upper wall 88 of hood 78 behind the keyways 95 and three latch recesses 102 are provided in the rear of the lower wall 90 of hood 78 behind the keyways 96.

The connector members of the embodiment illustrated in FIGS. 9 to 14 mate and lock in a similar fashion to the connector members illustrated in FIGS. 1 to 8. That is, the plug 52 and receptacle 66 are aligned so that the lugs 58 and 62 enter into the keyways 95 and 96, respectively. Pushing of the connector members together causes the lugs to bottom out against the beveled surfaces at the blind end of the keyways, thereby causing the hood to become deformed so that the lugs will pass beyond the inner surface of the hood and enter the recesses 100 and 102 thereby positively locking the connector members in their mated condition as seen in FIGS. 10 and 11.

Reference is now made to FIG. 14 of the drawings which illustrates the receptacle connector member unmated from the plug connector member. It will be noted that when the sides of the hood 78 are squeezed in the regions 94 in the direction indicated by the arrows in FIG. 14, the upper wall 88 of the hood shifts substantially in its own plane in a rightward direction as viewed in FIG. 14 and the lower wall 90 shifts in the leftward direction in substantially its own plane. Such deformation of the hood also causes the hood to change form from a parallelogram to a rectangle in that the upper wall 88 and lower wall 99 tend to spread slightly apart. Thus, the upper and lower walls move both laterally and outwardly upon squeezing the sidewalls of the hood.

Figure 12:
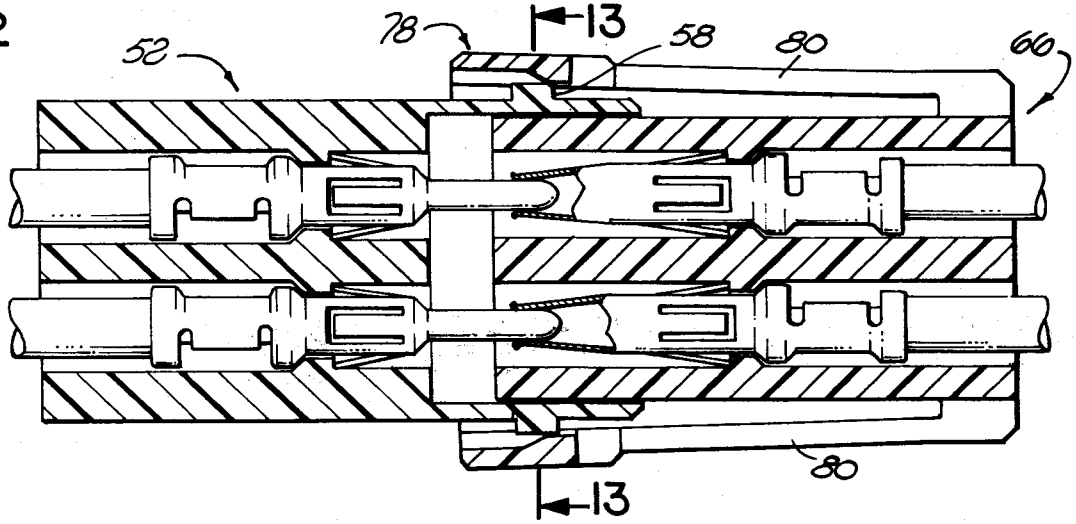
FIG. 12 is a partial longitudinal sectional view similar to FIG. 10 but showing the hood of the connector actuated to its unlatched position.

In order to unlock and unmate the mated electrical connector of FIGS. 9 to 14, the side regions 94 of the hood are squeezed in the manner just described, causing the upper and lower walls 88 and 90 to spread apart not only due to the change in form of the parallelogram but also due to the camming action resulting from the engagement of the sides of the latching recesses 100 and 102 against the beveled lugs 58 and 62, respectively. As a consequence, the lugs become disengaged from the latching recesses, as seen in FIG. 12, thereby unlocking the connector members and allowing them to be axially disengaged. When the hood 78 is changed from a parallelogram configuration to that of a rectangle, the ribs 80 connecting the hood to the body 64 undergo torsional flexure as in the first embodiment of the invention described herein. Thus, when the pressure on the sides of the hood is discontinued after unmating of the connector members, the hood will return to its original parallelogram form by the ribs 80 unflexing.

It will be appreciated that the embodiment of the connector illustrated in FIGS. 9 to 14 differs from the first embodiment disclosed herein of circular construction in that the regions 88 and 90 of the hood 78 embodying the latching recesses spread laterally outwardly as well as shift sideways is substantially the same planes in which they lie when the hood is actuated with the receptacle connector member disengaged from the plug connector member. However, in both cases, when the connector members are mated and the hoods are actuated, the sides of the latching recesses cooperate with the beveled sides of the latching lugs to cause the hoods to ride up over and disengage from the lugs so that the connector members may be disengaged.

It will be further appreciated that the connector members of the present invention may be molded as integral one-piece parts, thus leading to low cost and ease of manufacture. The connectors are versatile in operation, provide a reliable, stable locking of the connector members, and have long-term durability.

What is claimed is:

1. A quick detachable electrical connector comprising:

first and second axially mating connector members;

said first connector member comprising a body having forwardly extending resilient hood means thereon, said hood means having a forward end surrounding said second connector member when said members are mated and a rear end fixed against rotation on said body;

said second connector member and said hood means embodying cooperating latch and recess means for releasably locking said members together;

said hood means being capable of torsional displacement relative to said body, and thus said second connector member;

said latch and recess means becoming disengaged upon said torsional displacement of said hood means whereby said connector members may be axially disengaged; and said latch and recess means automatically locking said members together upon axial mating of said members and without torsional displacement of said hood means.

2. An electrical connector as set forth in claim 1 wherein:

said hood means includes a plurality of relatively thin longitudinally extending flexible ribs connected to said body.

3. An electrical connector as set forth in claim 1 wherein:

said second connector member and said hood means embody more than two of said latch and recess means.

4. A quick detachable electrical connector comprising:

first and second axially mating circular connector members;

at least one latch element extending outwardly from said first connector member;

said second connector member comprising a generally cylindrical body having a forwardly extending resilient, generally circular hood surrounding said first connector member, said hood having a recess therein receiving said latch element;

a plurality of relatively thin longitudinally extending flexible ribs connecting said hood to said body;

said hood being rotatable a limited distance relative to said body, and thus said first connector member,;

said ribs being torsionally flexed when said hood is rotated relative to said body; and said latch element and recess having adjacent surfaces generally parallel to the longitudinal axis of said body, one of said surfaces embodying cam means allowing said hood to ride up over said latch element upon rotation of said hood said limited distance to thereby release said latch element from said recess whereby said connector members may be axially disengaged.

5. An electrical connector as set forth in claim 1 wherein:

said first connector member includes more than two of said latch elements circumferentially spaced from each other; and said hood embodies a plurality of said recesses each positioned to receive one of said latch elements.

6. An electrical connector as set forth in claim 1 wherein:

said latch element has beveled longitudinally extending sides providing said cam means.

7. An electrical connector as set forth in claim 1 wherein:

said first connector member includes a plurality of said latch elements; and said hood embodies a plurality of said recesses each positioned to receive one of said latch elements.

8. An electrical connector as set forth in claim 7 wherein:

said hood is rotatable in opposite directions from a normal position in which said recesses receive said latch elements; and said cam means is on opposite sides of each said latch element allowing said hood to ride up over said latch elements upon rotation of said hood in either opposite direction from said normal position.

9. An electrical connector as set forth in claim 7 wherein:

said latch elements are disposed in a non-uniform pattern about said first connector member; and said hood embodies a plurality of blind keyways in its inner surface, said keyways opening at the front of said hood and being disposed in a pattern corresponding to the pattern of said latch elements; and said recesses are longitudinally aligned behind said keyways.

10. An electrical connector as set forth in claim 9 wherein:

the blind ends of said keyways are beveled.

11. A quick detachable electrical connector comprising:

first and second axially mating rectangular connector members;

at least one latch element extending outwardly from said first connector member;

said second connector member comprising a body having a forwardly extending resilient hood surrounding said first connector member, said hood having a recess therein receiving said latch element;

each said body and said first connector member having a generally rectangular cross-section providing top and bottom walls and a pair of sidewalls normal to said top and bottom walls;

said hood having the cross-section of a parallelogram providing top and bottom walls parallel to said body top and bottom walls, and sidewalls being disposed at an acute angle relative to said body sidewalls;

said recess being located in one of said top or bottom walls of said hood and said latch element being located on the corresponding top or bottom wall of said first connector member, said one top or bottom wall of said hood being movable in a plane parallel to the top and bottom walls of said body when said hood is squeezed by applying pressure to the sidewalls thereof; and said latch element and recess having adjacent longitudinally extending surfaces one of which embodies cam means allowing said hood to ride up over said latch element when said sidewalls of said hood are squeezed to thereby release said latch element from said recess whereby said connector members may be axially disengaged.

12. An electrical connector as set forth in claim 11 including:

a plurality of longitudinally extending flexible ribs connecting said hood to said body; and said ribs being flexed when said hood is squeezed.

13. An electrical connector as set forth in claim 11 wherein:

said latch element has beveled longitudinally extending sides providing said cam means.

14. An electrical connector as set forth in claim 11 wherein:

said first connector member includes a plurality of said latch elements at least one being on said top wall and at least one on said bottom wall thereof; and said hood embodies a plurality of said recesses on said top and bottom walls thereof located to receive said latch elements.

15. An electrical connector as set forth in claim 14 wherein:

said first connector member has more than two of said latch elements and said hood embodies a number of said recesses equal to the number of said latch elements.

16. An electrical connector as set forth in claim 14 wherein:

said latch elements are disposed in a non-uniform pattern about said first connector member; and said hood embodies a plurality of blind keyways in its inner surface, said keyways opening at the front of said hood and being disposed in a pattern corresponding to the pattern of said latch elements; and said recesses are longitudinally aligned behind said keyways.

* * * * *